US007422129B1

(12) United States Patent
Herbert et al.

(10) Patent No.: US 7,422,129 B1
(45) Date of Patent: Sep. 9, 2008

(54) BATHROOM ACCESSORY WITH INTEGRATED TOOTHPASTE DISPENSER, TOOTHBRUSH HANGER, AND SOAP HOLDER

(76) Inventors: Iry Herbert, 301 W. 22nd St., Riviera Beach, FL (US) 33404; Corey Herbert, 301 W. 22nd St., Riviera Beach, FL (US) 33404

( * ) Notice: Subject to any disclaimer, the term of this patent is extended or adjusted under 35 U.S.C. 154(b) by 358 days.

(21) Appl. No.: 11/253,885

(22) Filed: Oct. 18, 2005

(51) Int. Cl.
*B65D 35/24* (2006.01)

(52) U.S. Cl. ..... 222/93; 222/105; 222/185.1; 222/192; 222/386

(58) Field of Classification Search ..... 222/192, 222/93, 95–105, 183, 185.1, 183.1, 386; 132/310
See application file for complete search history.

(56) References Cited

U.S. PATENT DOCUMENTS 2,576,560 A * 11/1951 Bidmon ..... 312/206
3,204,823 A 9/1965 Watson, Jr.
4,223,809 A * 9/1980 Martin ..... 222/96
4,424,916 A 1/1984 Pearson
4,508,239 A 4/1985 Rozzen
4,570,829 A 2/1986 Allen
4,629,095 A 12/1986 Smith
4,705,194 A * 11/1987 Judge ..... 222/192
4,776,492 A * 10/1988 Gallo ..... 222/183
5,050,773 A 9/1991 Choi
5,230,444 A * 7/1993 Dunbar ..... 222/180
5,871,124 A * 2/1999 Wilkinson ..... 222/192
5,887,754 A 3/1999 Wilkinson
D420,843 S 2/2000 Cardillo
6,481,599 B1 * 11/2002 DeVaux ..... 222/192
6,789,703 B2 9/2004 Pierre-Louis
6,966,463 B1 * 11/2005 Yeager et al. ..... 222/181.3

* cited by examiner

*Primary Examiner*—Frederick C. Nicolas

(57) ABSTRACT

To attain this, the present invention generally comprises a bathroom accessory including a base section for resting on a surface, and a middle section located above the base section that defines an interior for receiving a tube of toothpaste to be dispensed. The accessory also includes a cap section forming a soap holding dish, and which is positioned at the upper end of the middle section. The cap section is removably mounted on the middle section to provide access to the interior of the middle section for positioning tube of toothpaste in the interior. The accessory further includes at least one toothbrush hook on the cap section for hooking onto a toothbrush; and a spout on the middle section for dispensing toothpaste from the tube of toothpaste.

18 Claims, 4 Drawing Sheets

BATHROOM ACCESSORY WITH INTEGRATED TOOTHPASTE DISPENSER, TOOTHBRUSH HANGER, AND SOAP HOLDER

BACKGROUND OF THE INVENTION

1. Field of the Invention

The present invention relates to organizing devices and more particularly pertains to a new bathroom accessory with integrated toothpaste dispenser, toothbrush hanger, and soap holder for conveniently holding a number of bathroom related items in a single centralized location.

2. Description of the Prior Art

The number of various toiletries that may be utilized in the typical bathroom are numerous, and the number seems to be growing every day. These various toiletries may be stored in drawers or shelves, away from the sink, but this can be inconvenient for use of the toiletries, especially those that are used several times during the day. For convenience, these frequently used items are often placed on the edge of the sink or on the counter next to the sink for easy and quick access, but the items often compete for the little available space in these areas.

Numerous devices designed to organize items used in the bathroom have been proposed. However, the known devices are felt to be lacking in their ability to minimize the amount of "real estate" about the sink that is occupied by the most frequently used toiletries, which include soap, toothpaste and toothbrushes.

It is therefore believed that there is a need for a bathroom accessory that holds the most frequently used toiletry items while occupying only a minimal amount of space about the sink.

SUMMARY OF THE INVENTION

In view of the foregoing disadvantages inherent in the known types of organizing devices now present in the prior art, the present invention provides a new bathroom accessory with integrated toothpaste dispenser, toothbrush hanger, and soap holder wherein the same can be utilized for integrating and consolidating the storage of a number of commonly-used bathroom items on one device.

To attain this, the present invention generally comprises a bathroom accessory comprising a base section for resting on a surface, and a middle section located above the base section that defines an interior for receiving a tube of toothpaste to be dispensed. The accessory also includes a cap section forming a soap holding dish, and which is positioned at the upper end of the middle section. The cap section is removably mounted on the middle section to provide access to the interior of the middle section for positioning tube of toothpaste in the interior. The accessory further includes at least one toothbrush hook on the cap section for hooking onto a toothbrush; and a spout on the middle section for dispensing toothpaste from the tube of toothpaste.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

One significant advantage of the present invention is the capability to consolidate the storage of several commonly and often used bathroom items in a convenient manner that is easily positionable on a counter or a sink, and also minimizes the amount of space that is occupied by these items on the counter or sink.

Further advantages of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects of the invention will become apparent when consideration is given to the following detailed description thereof. Such description makes reference to the annexed drawings wherein.

DESCRIPTION OF PREFERRED EMBODIMENTS

Figure 1:
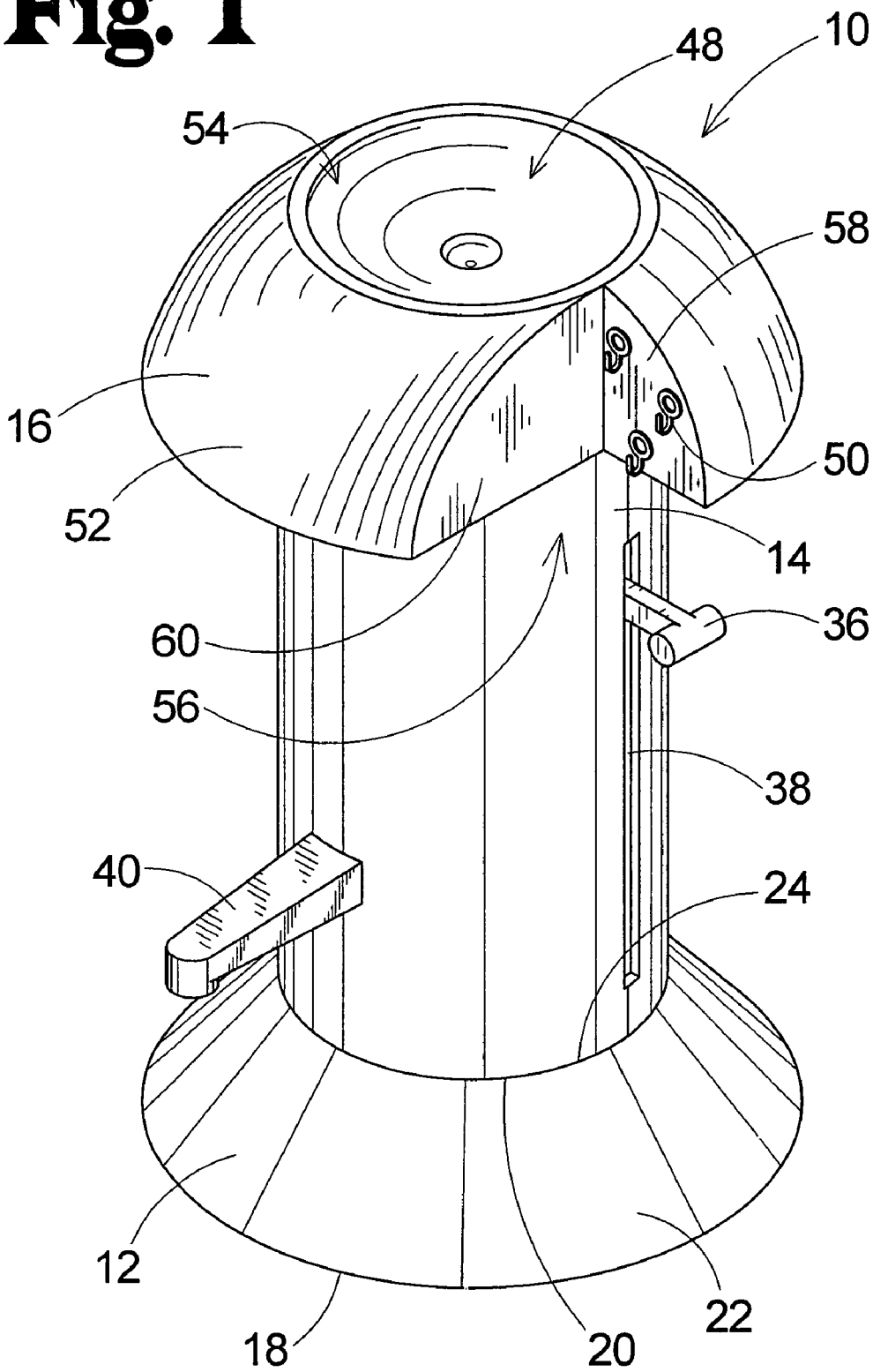
FIG. 1 is a schematic perspective view of a new bathroom accessory with integrated toothpaste dispenser, toothbrush hanger, and soap holder to the present invention.
Figure 2:
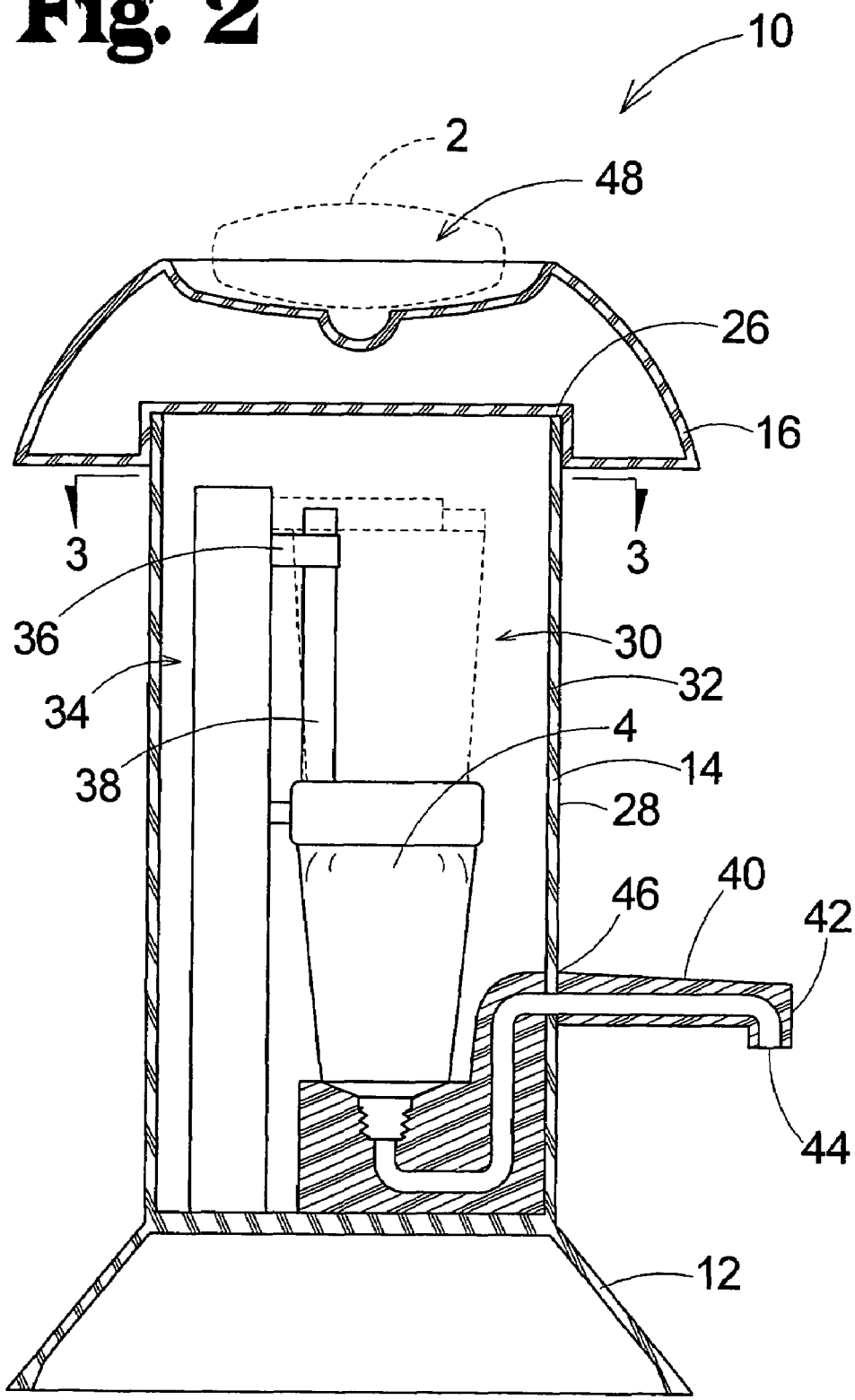
FIG. 2 is a schematic side sectional view of the present invention.

With reference now to the drawings, and in particular to FIGS. 1 through 4 thereof, a new bathroom accessory with integrated toothpaste dispenser, toothbrush hanger, and soap holder embodying the principles and concepts of the present invention and generally designated by the reference numeral 10 will be described.

The bathroom accessory 10 (see FIG. 1) of the invention is highly suitable for use in a bathroom, such as on a surface next to a sink, to provide convenient access to commonly used items such as soap 2, toothpaste 4, and toothbrushes 6. In the illustrative embodiment, the accessory 10 generally includes a base section 12 for resting on a surface, a middle section 14 located above the base section, and a cap section 16 located above the middle section.

In greater detail, the base section 12 has a lower end 18 and an upper end 20. The base section 12 has an outer surface 22, and the outer surface may have a substantially frustaconical shape such that the lower end 18 of the base section has a width greater than a width of the upper end 20.

The middle section 14 of the accessory 10 has a lower end 24 and an upper end 26, with the lower end 24 being connected to the base section. The middle section 14 (see FIGS. 2 and 3) has an exterior surface 28. The middle section 14 defines an interior 30 for receiving a tube of toothpaste 4 to be dispensed. The middle section 14 includes a perimeter wall 32, which extends about the interior of the middle section.

Figure 3:
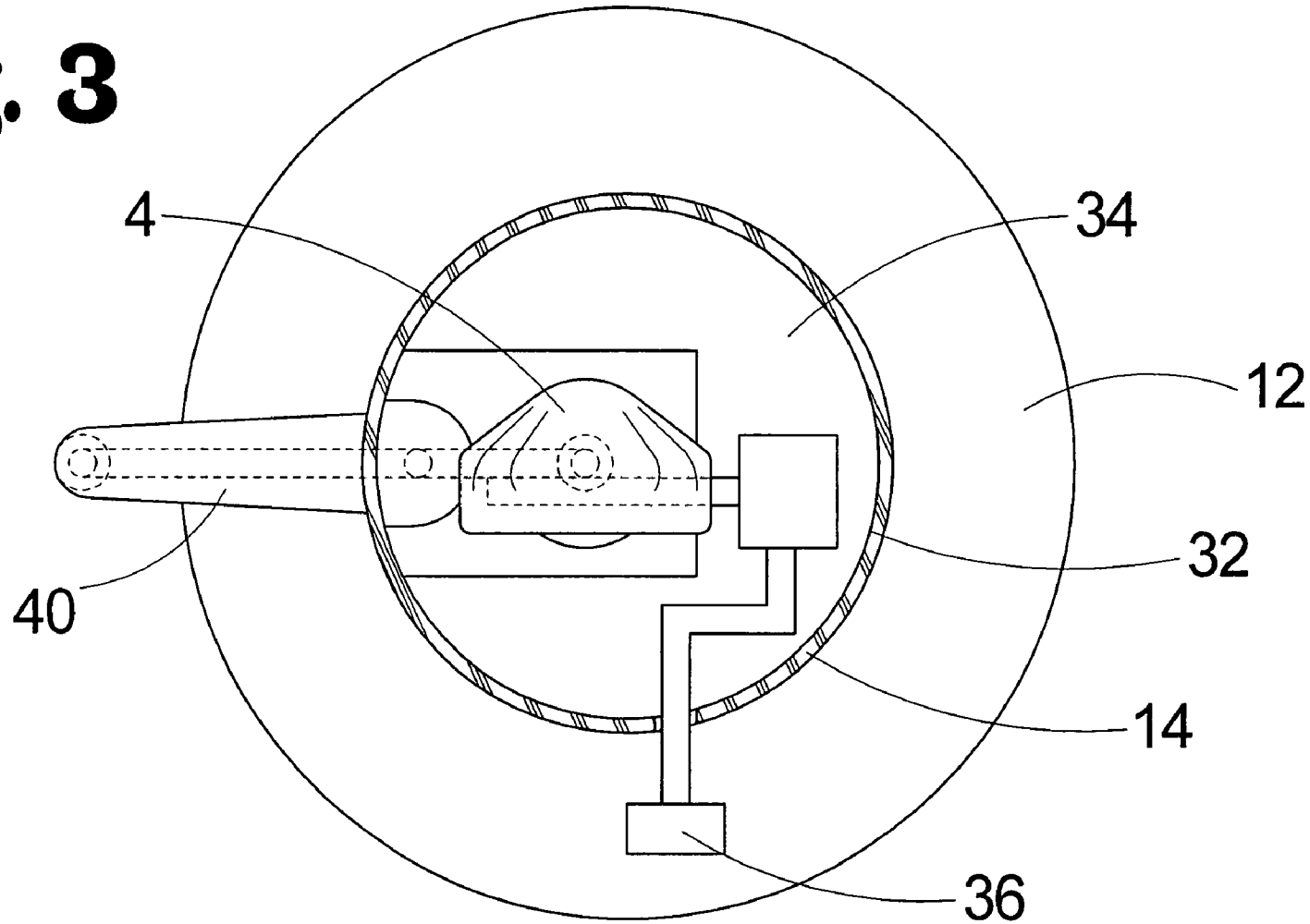
FIG. 3 is a schematic top sectional view of the present invention taken along line 3-3 of FIG. 2.
Figure 4:
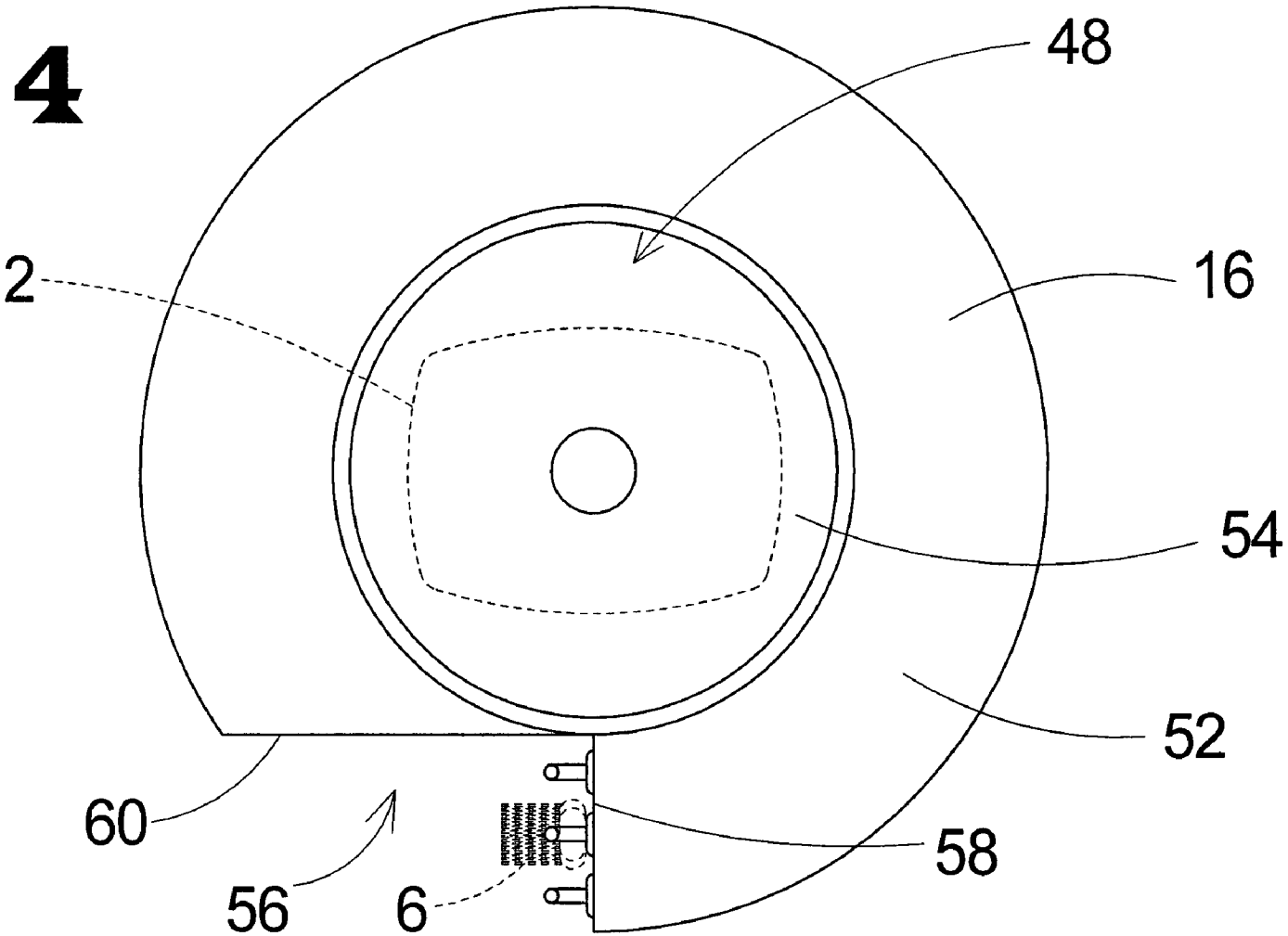
FIG. 4 is a schematic top view of the present invention.

The middle section 14 includes a toothpaste pumping system 34 for pumping the toothpaste out of a toothpaste tube positioned inside of the perimeter wall 32 of the middle section. The toothpaste pumping system 34 is schematically illustrated in FIGS. 3 and 4 of the drawings, and virtually any type of toothpaste pumping apparatus may be employed, including the various apparatus disclosed in U.S. Pat. No. 3,204,823 to Watson Jr., U.S. Pat. No. 4,424,916 to Pearson, U.S. Pat. No. 4,508,239 to Rozzen, U.S. Pat. No. 6,789,703 to Pierre-Louis, U.S. Pat. No. 4,570,829 to Allen, U.S. Pat. No. 5,050,773 to Choi, U.S. Pat. No. 4,629,095 to Smith, and U.S. Pat. No. 5,817,124 to Wilkinson, each of which is incorporated by reference in their entireties. The system 34 may include an actuating lever 36 for actuating the toothpaste pumping system. The actuating lever 36 is movable in a slot 38 formed in the perimeter wall 32 of the middle section, so that movement of the lever in the slot causes the system 34 to pump toothpaste from the tube 4.

The middle section 14 includes a spout 40 for dispensing toothpaste. The spout 40 extends from a side of the middle section 14, and has an outboard end 42, with a dispensing opening 44 being located on the outboard end. An inboard end 46 of the spout 40 is mounted on the middle section 14.

The cap section 16 is positioned at the upper end 26 of the middle section 14 and includes a depression that forms a soap holding dish 48. The cap section 16 may be removably mounted on the middle section 14 to provide access to the interior of the middle section to remove and replace the tube of toothpaste located in the interior 30 of the middle section. Optionally, the cap section 16 may be removably mounted on the middle section 14 by a threaded connection, and the upper end 26 of the middle section 14 may be exteriorly threaded and the cap section 16 is interiorly threaded in a complementary manner.

The cap section 16 includes at least one toothbrush hook 50 for hooking the toothbrush 6 on. In some embodiments of the invention, a plurality of toothbrush hooks 50 is located on the cap section 16 to support a plurality of toothbrushes.

The cap section 16 has an exterior surface, and the exterior surface includes a substantially hemispherical lower portion 52 and a dished-out upper portion 54 extending into the lower portion. The dished-out upper portion 54 forms the soap dish for the soap to sit in. The lower portion 52 may have a maximum width that is greater than a width of the middle section 14. Also, the maximum width of the cap section 16 may be approximately equal to a maximum width of the base section 12.

In some embodiments, a notch 56 that is formed in the cap section 16, and the toothbrush hook 50 may be located in the notch 56. The notch 56 may comprise a first wall 58 and a second wall 60 that extends inwardly into the cap section 16. The first wall 58 may extend substantially tangential to a section of the circumference of the dished-out upper portion 54 of the cap section, and the second wall 60 may extend substantially perpendicular to the section of the circumference of the upper portion 54. The toothbrush hook 50 may be located on the second wall 60, but optionally may be located on the first wall 58.

With respect to the above description then, it is to be realized that the optimum dimensional relationships for the parts of the invention, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A bathroom accessory comprising:

a base section for resting on a surface;

a middle section located above the base section, the middle section defining an interior for receiving a tube of toothpaste to be dispensed;

a cap section forming a soap holding dish, the cap section being positioned at an upper end of the middle section, the cap section being removably mounted on the middle section to provide access to the interior of the middle section for positioning the tube of toothpaste in the interior;

at least one toothbrush hook on the cap section for hooking onto a toothbrush; and a spout on the middle section for dispensing toothpaste from the tube of toothpaste;

wherein the cap section is removably mounted on the middle section in a manner such that rotation of the cap section permits removal of the cap section from the middle section; and wherein the cap section has an exterior surface, and the exterior surface includes a substantially hemispherical lower portion and a dished-out upper portion extending into the hemispherical portion.

2. The accessory of claim 1 additionally comprising a toothpaste pumping system for pumping the toothpaste out of a tube of toothpaste positioned in the middle section and dispensing the toothpaste from the spout.

3. The accessory of claim 2 wherein the toothpaste pumping system includes an actuating lever for actuating the toothpaste pumping system.

4. The accessory of claim 1 wherein the actuating lever is movable in a slot formed in a perimeter wall of the middle section.

5. The accessory of claim 1 wherein the at least one toothbrush hook includes a plurality of toothbrush hooks.

6. The accessory of claim 1 wherein the base section has a lower end and an upper end, the base section having an outer surface, the outer surface of the base section having a frustaconical shape such that the lower end has a width greater than a width of the upper end.

7. The accessory of claim 1 wherein the middle section has an exterior surface which is substantially cylindrical.

8. The accessory of claim 1 wherein the cap section has an exterior surface, and the exterior surface includes a substantially hemispherical lower portion and a dished-out upper portion extending into the hemispherical portion.

9. The accessory of claim 8 the substantially hemispherical portion has a maximum width that is greater than a width of the middle section, the maximum width of the cap section being approximately equal to a maximum width of the base section.

10. The accessory of claim 1 wherein the cap section has a notch formed therein, the at least one toothbrush hook being located in the notch.

11. The accessory of claim 8 wherein the cap section has a notch formed therein, the at least one toothbrush hook being located in the notch.

12. The accessory of claim 11 wherein the notch comprises a first wall and a second wall extending inwardly in the cap section, the first wall extending substantially tangential to a section of the circumference of the dished-out portion of the cap section and the second wall extending substantially perpendicular to the section of the circumference of the dished-out portion.

13. The accessory of claim 12 wherein the at least one hook is located on the second wall.

14. The accessory of claim 1 wherein the cap section is releasable and replaceable on the middle section to respectively open and close an opening on the middle section, the opening being in communication with the interior of the middle section.

15. The accessory of claim 1 wherein the base section, the middle section, and the cap section are configured such that when the base section is rested on a horizontal surface, the toothpaste pumping system is operable and a toothbrush is capable of being hooked on the at least one toothbrush hook.

16. The accessory of claim 1 wherein the base section, the middle section, and the cap section are configured such that when the base section is rested on a horizontal surface, the cap section is positioned above the base section and the middle section.

17. A bathroom accessory comprising:

a base section for resting on a surface;

a middle section located above the base section, the middle section defining an interior for receiving a tube of toothpaste to be dispensed;

a cap section forming a soap holding dish, the cap section being positioned at an upper end of the middle section, the cap section being removably mounted on the middle section to provide access to the interior of the middle section for Positioning the tube of toothpaste in the interior;

at least one toothbrush hook on the cap section for hooking onto a toothbrush;

a spout on the middle section for dispensing toothpaste from the tube of toothpaste;

a toothpaste pumping system for pumping the toothpaste out of a tube of toothpaste positioned in the middle section and dispensing the toothpaste from the spout;

wherein the toothpaste pumping system includes an actuating lever for actuating the toothpaste pumping system;

wherein the actuating lever is movable in a slot formed in a perimeter wall of the middle section;

wherein the at least one toothbrush hook includes a plurality of toothbrush hooks;

wherein the base section has a lower end and an upper end, the base section having an outer surface, the outer surface of the base section having a frustaconical shape such that the lower end has a width greater than a width of the upper end;

wherein the middle section has an exterior surface which is substantially cylindrical;

wherein the cap section is removably mounted on the middle section by a threaded connection, the upper end of the middle section being exteriorly threaded and the cap section being interiorly threaded in a complementary manner;

wherein the cap section has an exterior surface, and the exterior surface includes a substantially hemispherical lower portion and a dished-out upper portion extending into the hemispherical portion;

wherein the substantially hemispherical portion has a maximum width that is greater than a width of the middle section, the maximum width of the cap section being approximately equal to a maximum width of the base section;

wherein the cap section has a notch formed therein, the at least one toothbrush hook being located in the notch;

wherein the notch comprises a first wall and a second wall extending inwardly in the cap section, the first wall extending substantially tangential to a section of the circumference of the dished-out portion of the cap section and the second wall extending substantially perpendicular to the section of the circumference of the dished-out portion; and wherein the at least one hook is located on the second wall.

18. A bathroom accessory comprising:

a base section for resting on a surface;

a middle section located above the base section, the middle section defining an interior for receiving a tube of toothpaste to be dispensed;

a cap section forming a soap holding dish, the cap section being positioned at an upper end of the middle section, the cap section being removably mounted on the middle section to provide access to the interior of the middle section for positioning the tube of toothpaste in the interior;

at least one toothbrush hook on the cap section for hooking onto a toothbrush; and a spout on the middle section for dispensing toothpaste from the tube of toothpaste;

wherein the cap section is removably mounted on the middle section by a threaded connection, the upper end of the middle section being exteriorly threaded and the cap section being interiorly threaded in a complementary manner.

* * * * *